US005775060A

United States Patent [19]

Ferrero

[11] Patent Number: 5,775,060

[45] Date of Patent: Jul. 7, 1998

[54] PROCESS FOR FORMING WRAPPERS OF THIN SHEET MATERIALS AND A DEVICE FOR CARRYING OUT SAME

[75] Inventor: Pietro Ferrero, Waterloo, Belgium

[73] Assignee: Soremartec S.A., Belgium

[21] Appl. No.: 170,233

[22] PCT Filed: Jun. 25, 1992

[86] PCT No.: PCT/EP92/01438

§ 371 Date: Feb. 17, 1994

§ 102(e) Date: Feb. 17, 1994

[87] PCT Pub. No.: WO93/01093

PCT Pub. Date: Jan. 21, 1993

[30] Foreign Application Priority Data

Jul. 3, 1991 [CH] Switzerland ..... 1984/91

[51] Int. Cl.[6] ..... B65B 47/04

[52] U.S. Cl. ..... 53/453; 29/17.1; 29/17.2; 53/411; 425/396; 425/398

[58] Field of Search ..... 29/17.1, 17.2; 72/348, 379.6, 701; 53/453, 411; 425/394, 396, 398; 427/299, 327, 444; 493/463

[56] References Cited

U.S. PATENT DOCUMENTS

| | | | |
|---|---|---|---|
| 511,392 | 12/1893 | White | 72/379.6 |
| 2,059,292 | 11/1936 | Taylor | 72/379.6 |
| 2,133,357 | 10/1938 | Mazer | 72/379.6 X |
| 2,605,504 | 8/1952 | Feldman | 425/396 |
| 2,664,593 | 1/1954 | Larson | 425/398 X |
| 3,144,974 | 8/1964 | Eichner et al. . | |
| 3,251,319 | 5/1966 | Kaupert et al. | 53/453 X |
| 3,444,589 | 5/1969 | Bowin | 425/396 |
| 3,491,573 | 1/1970 | Tennison, Sr. | 72/348 |
| 3,748,889 | 7/1973 | Miller et al. | 72/382 |
| 3,800,497 | 4/1974 | Pearson | 53/411 |
| 4,246,223 | 1/1981 | Patterson | 264/292 |
| 4,707,899 | 11/1987 | Singer | 72/379.6 X |
| 5,014,536 | 5/1991 | Saunders | 72/348 |
| 5,174,146 | 12/1992 | Heurteboust et al. | 72/348 |

FOREIGN PATENT DOCUMENTS

| | | |
|---|---|---|
| 598113 | 5/1934 | Germany . |
| 1784647 | 3/1959 | Germany . |
| 651202 | 1/1963 | Italy . |

*Primary Examiner*—Joseph M. Gorski

*Attorney, Agent, or Firm*—Rothwell, Figg, Ernst & Kurz

[57] ABSTRACT

This invention pertains to a method and apparatus for wrapping an article, wherein a metal foil is pleated and then formed in to a dished shape such that the pleats unfold, and then an article is placed within this dished shape.

34 Claims, 4 Drawing Sheets

Figure 1:
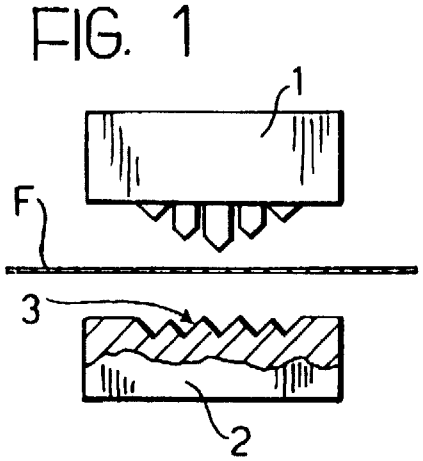

PROCESS FOR FORMING WRAPPERS OF THIN SHEET MATERIALS AND A DEVICE FOR CARRYING OUT SAME

The present invention relates in general to the formation of wrappers (or coverings) of thin sheet materials and has been developed with particular attention to its possible use for producing wrappers for confectionery products such as, for example, chocolate eggs.

In this field of application, reference to which should not, however, be interpreted in a limiting sense, there is generally a problem in fitting the shape of the wrapper (which typically is made of thin sheet material such as, for example, aluminium foil) to the shape of the product to be wrapped. The product may include one or more rounded portions or may be wholly constituted by such portions; for example, it may be a chocolate egg constituted by two complementary portions each of which has a rounded shape; the same can also be said of generally spherical products and the like.

Up to now, two different solutions have been used to form wrappers of thin sheet material for such products.

The first solution, the use of which predominates widely in industry, is that of taking the generally flat sheet material and wrapping it around the product to be wrapped by means of automatic or semi-automatic equipment which copies the sequence of steps which would be carried out by a human operator.

This solution is certainly satisfactory for many applications, particularly when the wrapping sheet is uniform in appearance (for example, a sheet of silvered or gilded aluminium) so that the random or pseudo-random distribution of folds formed in the sheet when it is wrapped around the product has no particular relevance; the distribution of folds may thus actually help to make the appearance of the wrapped product more pleasing, at least in some cases. If pictures, drawings or wording are applied to the wrapper, however, the situation is more difficult; in this case, the formation of folds in the wrapping sheet may detract from a general appreciation of the graphic symbols and, at least in some cases, may make the wording applied to the wrapper practically illegible.

Another solution which is documented, for example, by Italian patent 651,202, German patent 598,113, and also German patent 1,784,647 provides for the sheet wrapper to be preformed before it is applied to the product to be wrapped so that it assumes beforehand a shape which exactly fits the product to be wrapped. The preforming of the sheet material can be controlled precisely so as to limit, if not completely eliminate, the formation of folds, thus preventing the problems cited above. This solution has found considerable success, particularly with plastics wrapping materials, for which the preliminary forming operation can be effected by heating the material so as to soften it and then forming it by various moulding techniques.

The application of this solution to metal wrapping sheets, typically aluminium foil, however, appears more difficult. In practice, it is found that the technique of preforming metal foil can be used successfully only with materials of a certain thickness (for example, a few tenths of a millimeter, as is the case with some aluminium foil wrappers used for some pharmaceutical products, such as suppositories, or for making trays for holding products).

Furthermore, U.S. Pat. No. 3,748,889 disclosed a method and a die assembly for pleating a thin sheet of material, which permits the workpiece to be gathered and stretched by means of a progressive deformation which minimises the risk of tearing and splitting the material.

Without wishing to be bound to any particular theory in this connection, one has reason to believe that the chances of success with this technique are linked essentially to the use of materials of thicknesses such that the wrapper or covering can be preformed by a drawing process, that is, with a certain stretching of the material, without causing tears.

When the material of the wrapper is thin, however, (as in the case of aluminium foil of the order of 10–20 μ thick) it is practically impossible to preform the foil (for example, to give it a dished shape like the portions which constitute a chocolate egg) without it tearing or splitting.

According to a solution tested by the Applicant, the tearing of the wrapper or covering during the preforming can be prevented, to a certain extent, by subjecting the foil to an embossing process, which term, in the field of sheet materials, means the formation of a dense pattern of surface irregularities (for example, in the form of small cones, cylinders, or a generally "ravioli-like" structure) with dimensions generally smaller than 1 mm. The Applicant has found, however, that such a solution is unsatisfactory since it does not bring the tearing of the sheet material during preshaping below a statistically appreciable level.

The object of the present invention, therefore, is to provide a method of forming wrappers of thin sheet material, particularly metal foil, which does not give rise to the problems described above.

According to the present invention, this object is achieved by virtue of a method having the specific characteristics recited in claim 1. Advantageous developments of the invention are recited in claims 2 to 26.

Another subject of the invention is a device or tool for carrying out the method of the invention as claimed in claim 27. Further advantageous developments of this device are recited in claims 28 to 39.

Briefly, the present invention is based on the recognition of the fact that a wrapper of a thin material, particularly metal such as, for example, aluminium, can be formed into a generally dished shape, for example, in order to form part of a wrapper for covering one of the halves of a chocolate egg, without the risk of tearing, provided that, before the forming step, the sheet undergoes a pleating process which is preferably effected along meridians of the dished shape (in the manner which will be explained further below).

By way of premise, it should be noted that, the term "pleating" as used in the present description and the in the following claims, refers to the formation, in a sheet material, of a series of folds or pleats having dimensions generally larger than one millimeter, typically of the order of at least a few millimeters, for example, 5–8 millimeters or more.

Figure 9:
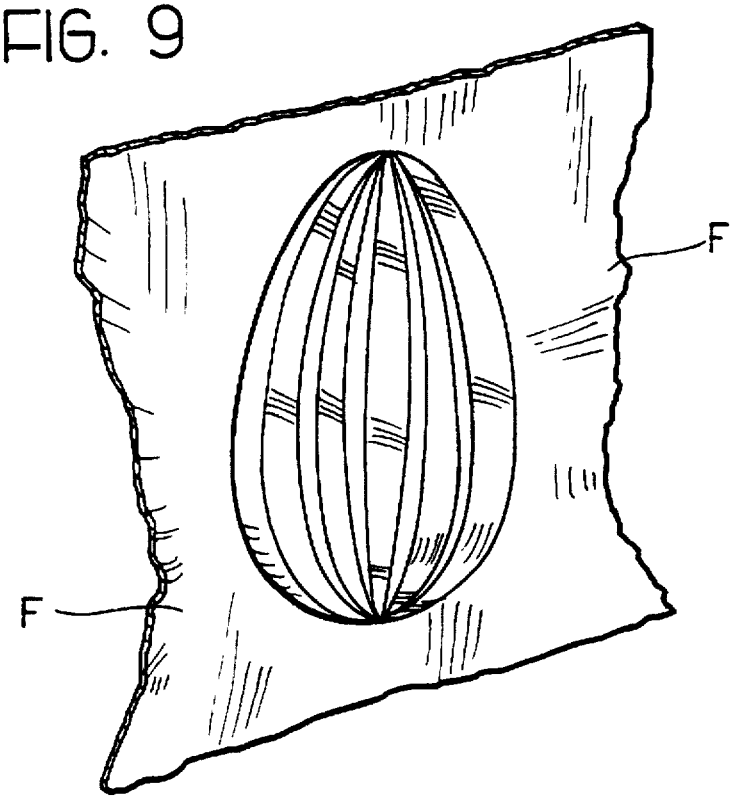
Figure 10:
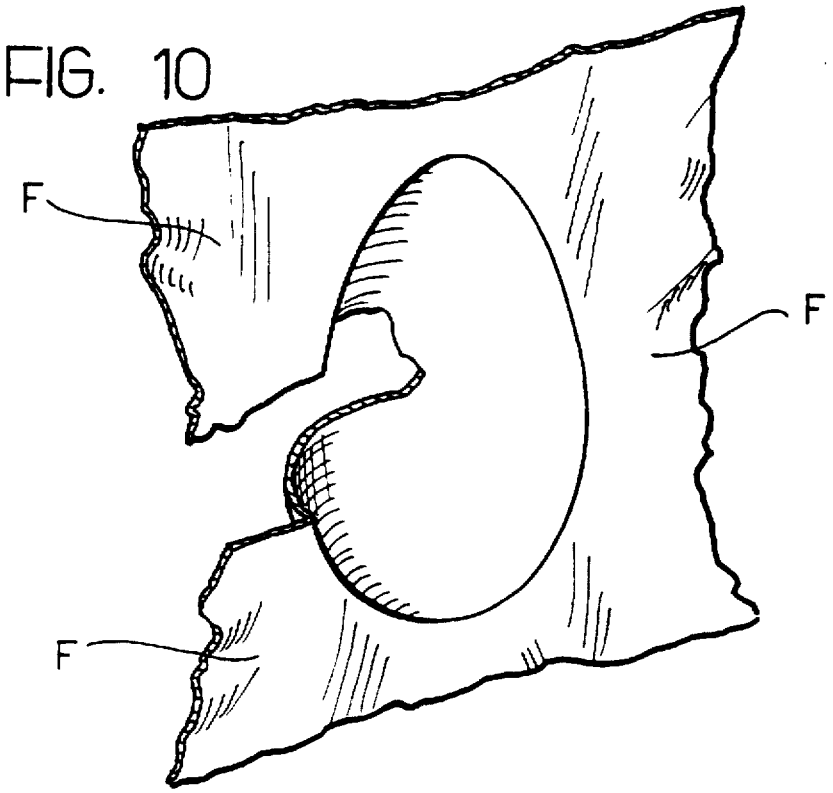
Figure 11:
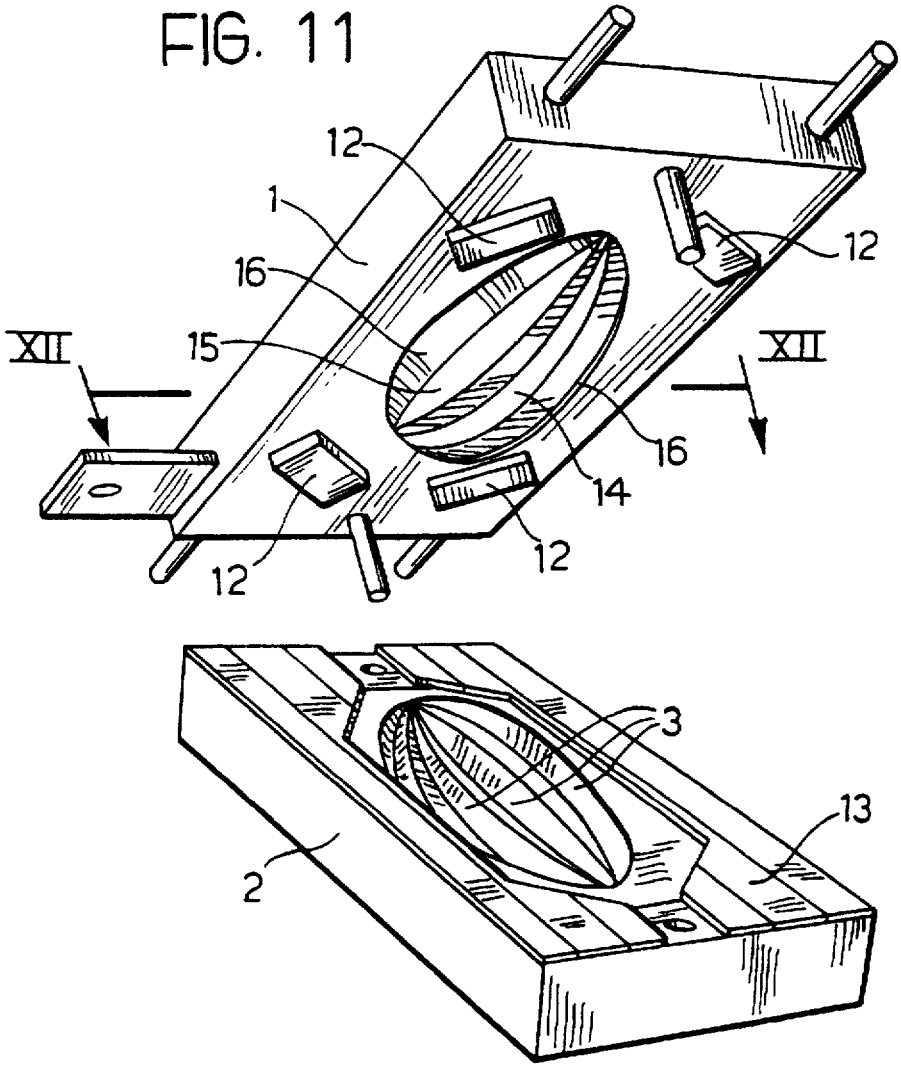
Figure 12:
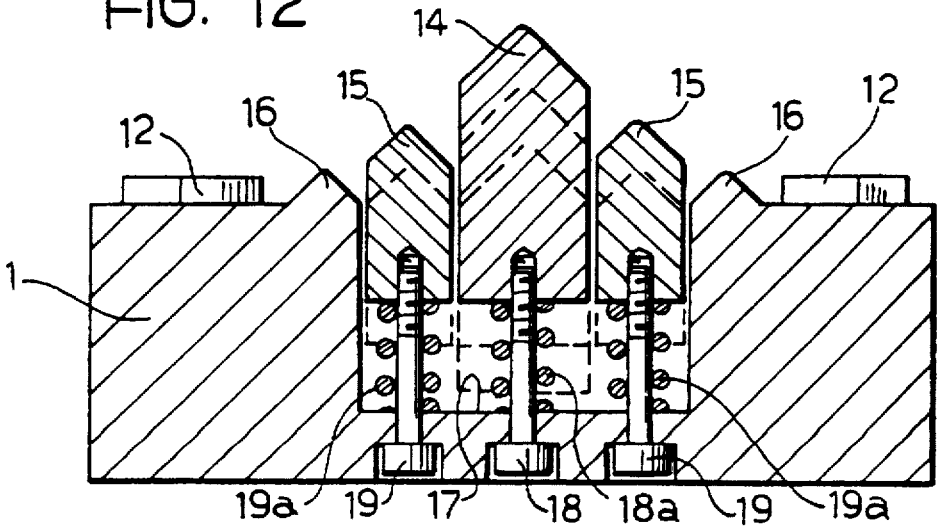

The invention will now be described, purely by way of non-limiting example, with reference to the appended drawings, in which:

FIGS. 1 to 8 show schematically various steps of a method according to the invention, FIGS. 9 and 10 show in greater detail the results obtained by some of the steps of FIGS. 1 to 8, FIG. 11 shows in greater detail the structure of a device for use in the method according to the invention, FIG. 12 is a section taken on the line XII—XII of FIG. 11, and FIGS. 13 to 15 show the operation of the device of FIGS. 11 and 12, in greater detail.

The present invention will be described, by way of example, with reference to the formation of a thin aluminium wrapper (with a thickness of the order of 10–20 μ, typically 11.4 μ) for a product constituted by a chocolate egg U of substantially the same dimensions as a hen's egg.

In particular, FIGS. 1 to 4 show schematically the sequence of steps which lead to the formation of one of the two symmetrical halves of the wrapper, that is, of the dished portion (shown in detail in FIG. 10) which is intended to cover one half of the egg U. FIGS. 5 to 8, however, show how two dished portions formed by the sequence of steps of FIGS. 1 to 4 can be arranged around a chocolate egg U so as to form a wrapper of thin sheet material.

As already indicated, the method of the invention may, however, be used for different applications, and hence for wrapping products other than confectionery or food products in general or for wrapping products which are not egg-shaped or spherical, for example, for wrapping products such as roughly hemispherical pralines. In the latter case, the method of the invention could, to advantage, be used to form the dished portion for covering the hemispherical portion of the product. The dished portion formed according to the invention could be joined, for example, to a flat or cup-shaped sheet constituting the portion of the wrapper which is wrapped around the base of the product. The method of the invention may also, to advantage, be used to form only a particular dished portion of part of a larger wrapper.

FIG. 1 shows how the sheet wrapping material F (for example, aluminium foil 11.4 μ thick) can be passed through a unit including a punch 1 and a die 2 having the specific characteristics recited below with reference to FIGS. 11 and 12, in order to form a generally pleated effect therein.

In the industrial method, the sheet wrapping material F advances towards the punch-die unit 1, 2 from an unwinding reel (not shown) and may be divided, beforehand or simultaneously, into small sheets for forming respective dished wrapping portions.

As will become clearer from the following, the die 2 (or the female portion of the pleating device) represents a general development in a plane of the overall shape of the product to be wrapped by the sheet F. For example, in the case of a spherical product, the die 2 will be generally circular, whereas in the case of an egg-shaped product (which is the specific case to which the present description relates) it will be generally oval (and flat). In both cases, the die 2 has a series of grooves 3 of approximately triangular cross-section extending generally along meridians of its shape. For example, in the case of an oval die (see also FIG. 11), the grooves 3 extend in a generally symmetrical arrangement from the base of the egg-shape towards its tip. As already stated, the grooves 3—and hence the corresponding pleats formed in the sheet F—have dimensions of the order of at least a few millimeters.

Figure 2:
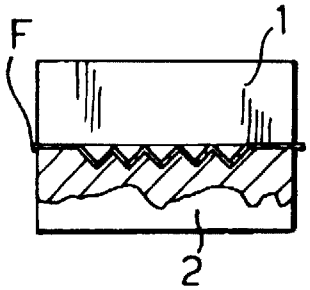
Figure 3:
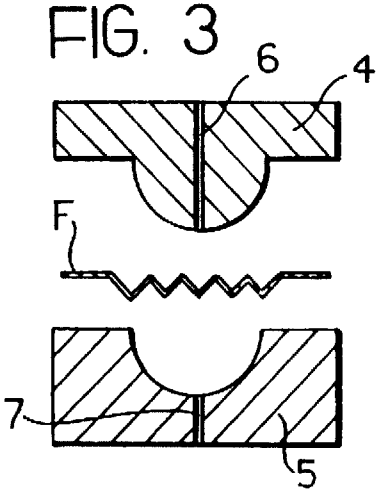
Figure 4:
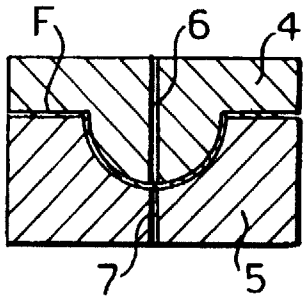
Figure 5:
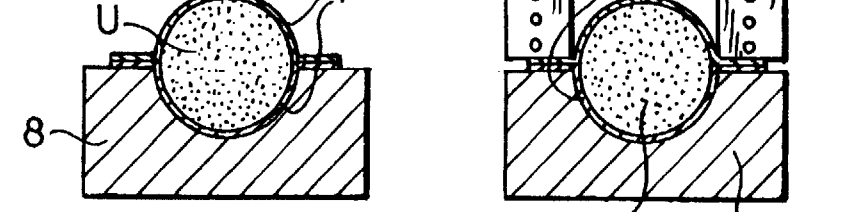

FIG. 2 shows schematically the situation in which the punch 1 and the die 2 have come into contact with each other, clamping the sheet F between them and thus forming the pleats therein.

As will become clearer from the following, during the pleating operation, the sheet F is not clamped completely rigidly but retains a certain ability to slide between the punch 1 and the die 2, giving rise to a general inward movement towards the centre of the pleating device 1, 2 as the pleating operation gradually proceeds. This movement towards the centre is facilitated, as will become clearer from the following, by the conformation of the punch 1 which, in the rest condition, has a generally three-dimensional shape with central portions which project further than its peripheral portions, and which—during its movement in order to mate with the die 2—gradually changes to a generally flat configuration.

The Applicant has found that the ability to slide, which is also facilitated by the presence of a lubricant lacquer (for example, a polyethylene lacquer) on at least one or, even better, on both faces of the sheet F, is extremely advantageous for preventing the risk of tearing.

The sheet F which is being pleated (shown in detail in FIG. 9) is then passed (FIGS. 3 and 4) to a further forming device which is also constituted by a punch 4 and a die 5. These are intended to effect the actual forming of the already-pleated sheet F, giving it a shape precisely corresponding to that of the product (the egg U in the embodiment to which the present description relates) to be covered by the sheet.

In the specific embodiment, the punch 4 and the die 5 will therefore have positively and negatively dished (half) egg-shapes, respectively.

As a result of the mating of the punch 4 and the die 5 (see FIG. 4), the sheet F assumes the dished, egg-shaped configuration to be imparted thereto, as shown in FIG. 10.

As a result of the previous pleating process (FIGS. 1 and 2), the dishing can be achieved without risk of tearing, even with very thin sheets F, for example, 11.4 μ thick aluminium foil.

Without wishing to be bound to any particular theory in this connection, one has reason to believe that the main effect of the pleating operation is to prevent any stretching of the material (which does, however, occur in solutions in which the forming is carried out directly on a flat sheet) during the subsequent forming operation, even as a result of its slight movement towards the centre, mentioned above.

In this case, it has also been found that the presence of a lacquer which has a lubricating effect on one or, even better, on both faces of the sheet F is beneficial in further reducing any risk of tearing.

Moreover, it has been found advantageous for both the punch 4 and the die 5 to have ducts 6, 7 for quickly discharging from the device any masses of air trapped between the punch 4 and the sheet F, on the one hand, or between the sheet F and the die 5, on the other hand, particularly when—as occurs in industrial processes—the pressing is to be carried out particularly quickly (with pressing times of less than one second).

At this point, the two half-egg-shaped wrapper pressings produced from the sheet F as shown in FIG. 10 can be used to cover a chocolate egg U.

For this purpose, a first half-egg-shaped pressing F can be placed in a holding die 8 (which may in fact correspond to the die 5 used for the forming) in order to receive the egg U (which is formed according to widely known criteria in a moulding line, not shown) so that only the upper half of the egg U is left projecting from the die 8.

Another pressing such as that shown in FIG. 10 can then be positioned thereon, so that the egg U is completely surrounded by sheet wrapping material.

At this point, it is necessary to close the formed wrapper and this can be achieved by joining the two half-egg-shaped wrapper pressings F together along their mutually facing portions around the periphery of the egg U enclosed between them.

This can be achieved, at least in principle, by various techniques, such as mechanical joining by folding, gluing, ultrasonic welding, heat-sealing of the material constituting the wrapper pressings F, etc., possibly with the simultaneous cutting of the sheets F which are joined together around the periphery of the egg U.

In this connection, the need to satisfy a set of concomitant requirements should, however, be noted.

In the first place, the two aluminium wrapper pressings F must be joined without damaging the egg U, even locally.

This risk may arise if the two sheet wrapper pressings F are joined together by heat-sealing the material of which they are made.

On the other hand, it is desirable for the sheet pressings F to be cut as close as possible to the product U in order to prevent the rim or "Saturn's ring" 11 which is formed around the egg U as a result of the cutting of the aluminium pressing from projecting too far, which would adversely affect its appearance even if the rim or ring 11 were then to be folded against the product U according to a current solution.

In this connection, the solution (which has already been mentioned for other reasons) of using a sheet material F which has a layer of heat-sealable lacquer or resin, for example polyethylene lacquer, on at least one of its faces (and, in particular, on the face which is intended to face the product U) has been found particularly advantageous.

As has been seen, the presence of the layer of lacquer is beneficial for effecting the pleating operation. Moreover, the lacquer is wholly compatible with use for wrapping food products. Furthermore, the lacquer enables the two wrapper pressings F to be welded together easily by the lowering of a so-called heating muffle 9 near the region of the joint between the two pressings F around the periphery of the product U. In practice, the muffle 9 is constituted by an annular heated body defining an aperture, the shape of which closely imitates the outline of the egg U between the two pressings F of sheet material. Once it bears on the lips of the two pressings which are in contact with each other, as shown schematically in FIG. 6, the muffle 9, which is brought to a temperature of the order of 80°, can melt the lacquer or resin locally so as to weld and securely join the two pressings F of sheet material together within a period of about 1 second. This causes no damage to the egg U (both because of the relatively low temperature and because of the short time of application).

The joint formed between the two pressings F of sheet material by the local melting of a lacquer or resin which covers their mutually facing surfaces is also beneficial for ensuring that the wrapper is completely sealed, even if there are slight folds or wrinkles along the mouth portions of the two pressings which are joined together.

Figure 6:
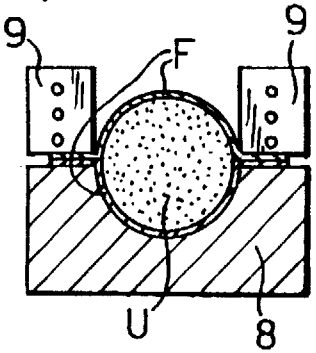
Figure 7:
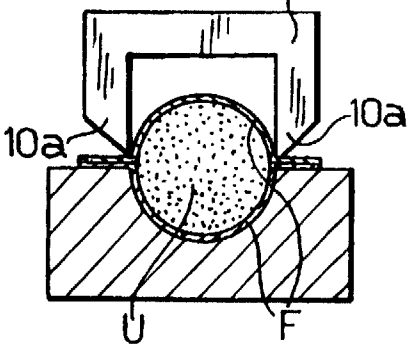
Figure 8:
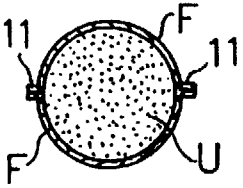

The welding together of the two pressings F of sheet material, to which FIG. 6 relates, is followed by the cutting of the wrapper around the periphery of the egg U. This can be achieved with the use, for example, of a hollow punch 10 with a cutting edge 10*a*, the profile of which corresponds approximately to the outline of the product U in the region in which the two pressings F of sheet material are joined. In general, the cutting edge 10*a* follows the outline of the product U with a certain clearance so that its cutting action forms the rim or outer ring 11 constituted by the joined portions of the sheet material F when the tool 10 is removed (also removing the flat outer peripheral portions of the two pressings F of sheet material). This ring or rim forms a sort of flange 1 or 2 mm wide which projects from the finally wrapped product U. The ring or rim 11 can be folded against the outer surface of the wrapper by a subsequent folding operation.

In other applications, however, the ring or rim 11 may be left unchanged since its presence does not adversely affect the appearance of the final product.

Continuing with a more detailed examination of the structure of the pleating device 1, 2, (see in particular FIGS. 11 and 12), it can be seen that at least one and, preferably, both of the punch 1 and the die 2 have restraining formations 12, 13 in the generally flat regions surrounding the actual male and female die portions (which have the characteristics described in greater detail below), the restraining formations 12, 13 being constituted, for example, by portions 12 of foamed strip stuck to the flat surface of the male die 1 and an almost complete covering 13 on the flat face of the female die (the matrix) 2, also formed, for example, by an adhesive foamed strip.

Naturally, the relative positions of the portions 12 and of the covering 13 could be reversed with the portions 12 on the female die 2 and the substantially continuous covering 13 on the flat face of the male die 1.

As stated, the restraining elements 12 are formed, for example, by foamed strips each having an adhesive surface so that it can be applied firmly to the flat face of the respective die element 1 or 2, leaving free a generally smooth surface (that is, the surface facing the complementary die) which has a certain ability to yield resiliently.

The formations 12 and 13 are intended to grip the sheet F when it is interposed between the die portions 1 and 2 for the pleating operation.

The formations 12 and 13 actually grip the sheet F in a generally yielding or gentle manner, in the sense that they do not completely oppose the gradual movement of the sheet F towards the centre of the pleating device.

It can be seen in the lower portion of FIG. 11, which relates to the matrix or female die 2, that the shaped portion of the die 2 has a set of ribs or grooves 3 which are oriented along its meridians for forming the pleats. By way of example, with reference to the formation of a wrapper for wrapping a chocolate egg having the size of a normal hen's egg, the matrix 3 may have a set of five grooves with generally triangular or V-shaped cross-sections, including a central groove, two intermediate side grooves and two outer side grooves. Naturally, different solutions may be used, according to the dimensions and the general shape of the product to be covered. The same configuration of shaped portions is naturally used in a complementary manner, that is, in the form of ribs, on the male die or actual punch 1, which is shown in greater detail in the upper portion of FIG. 11 and, in section, in FIG. 12.

In the embodiment illustrated, the male die 1 thus also has five ribs with triangular or V-shaped cross-sections.

More precisely, it has a central rib 14, two intermediate side ribs 15 and two outer side ribs 16 for cooperating respectively (with the interposition of the sheet F to be pleated) with the central groove, the intermediate side grooves and the outer side grooves of the female die 2.

As already stated in the introduction to the present detailed description, whereas the female die or matrix 2 is generally flat (this term meaning it has a discontinuous profile extending substantially in alignment with the flat portion of the die 2), the male die 1, however, has a profile which—in the rest condition (that is, before it engages the die 2)—is not flat, in the sense that the central rib 14 projects beyond the intermediate side ribs 15 which in turn project beyond the outer side ribs 16. Naturally the term "project beyond" is intended to define a situation in which the respective rib projects or extends further from the die 1 than the adjacent outer ribs.

This can be achieved, as shown schematically in FIG. 12, if the outer side ribs 16 are formed as parts which are integral with or fixed to the structure of the die 1 but the intermediate side ribs 15 and the central rib 14 are formed as blocks or punches which can slide relative to the body of the die 1.

Specifically, the inner boundaries of the outer side ribs 16 of the punch 1 define a generally oval or lenticular cavity 17 in which the intermediate side ribs 15 (which are thus generally C-shaped) can slide. The intermediate ribs 15 in turn define a further lenticular cavity in which the central rib 14, which in turn is generally keel or fin-shaped, can slide.

Respective screws, indicated 18 and 19, extend through holes in the end wall of the punch 1 (that is, through the face of the punch 1 which faces away from the mouth of the cavity 17). The screws 18 and 19 extend respectively into the central rib 14 and into each intermediate side rib 15 so as to regulate the sliding of the ribs into the cavity 17 against the reaction force exerted by respective springs 18*a*, 19*a* which are fitted around the shanks of the screws 18 and 19 within the cavity 17. Each spring acts between the end wall of the cavity 17 and the rib (the central rib 14 or an intermediate side rib 15) through which the corresponding screw 18 or 19 extends, urging the respective rib 14 or 15 outwardly of the die 1.

The spring 18*a* associated with the central rib 14 usually has a lower elastic constant than the spring 19*a* associated with the intermediate side ribs 15.

Thus, the arrangement is such that, starting from the rest position shown in continuous outline in FIG. 12, the rib 14, and subsequently the ribs 15, can be made to enter the cavity 17 gradually. This takes place with a movement which, for the central rib 14, is represented by an intermediate position shown in chain line and an end position shown in broken outline, the intermediate side ribs 15 travelling from the rest position indicated in continuous outline towards the end position shown in broken outline.

It will be appreciated that, when the ribs 14 and 15 are in their end positions, the punch 1 also assumes a generally flat configuration complementary to that of the die 2.

As stated, the sheet F is pleated by interposing the generally flat sheet F between the punch 1 and the die 2.

At the start of the pleating operation (with the punch 1 and the die 2 separated), the punch 1 is thus in the rest condition shown in continuous outline in FIG. 12. As a result of the gradual movement of the punch 1 towards the die 2, the sheet F will then be engaged first by the central rib 14 which will engage the corresponding central groove of the die 2, thus forming a first central pleat in the sheet F. As the coupling movement of the two die elements 1 and 2 continues, the central rib 14 will start to be retracted into the punch 1, so that the intermediate side ribs 15 start to engage the corresponding intermediate side grooves in the die 2, thus forming two further pleats in the sheet F which is being pleated.

Finally, as the coupling movement of the punch 1 continues further towards the die 2, the ribs 15 will start to move towards the end wall of the cavity 17 (like the central ribs 14, which continue to be retracted into the punch 1) so that the outer side ribs 16 come into engagement with the corresponding grooves in the die 2, thus forming the outermost pleats in the sheet F.

Figure 13:
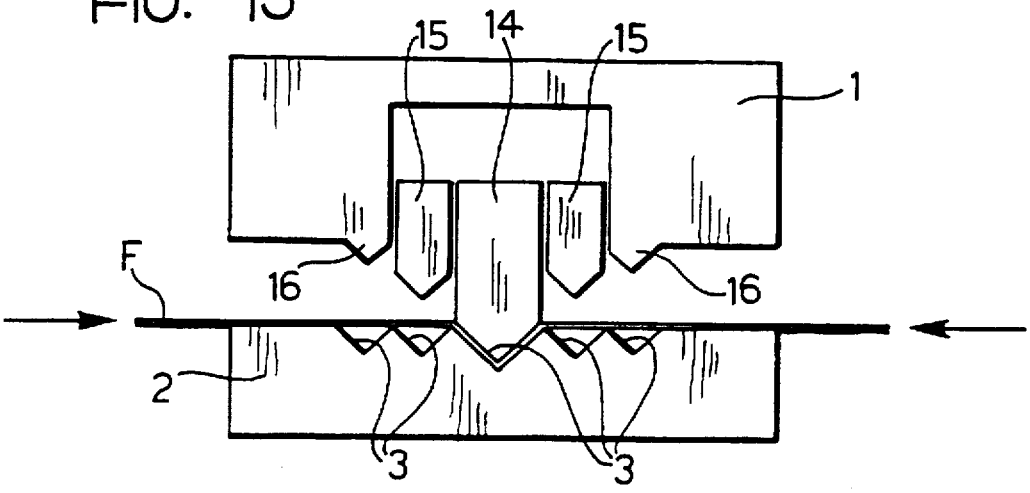
Figure 14:
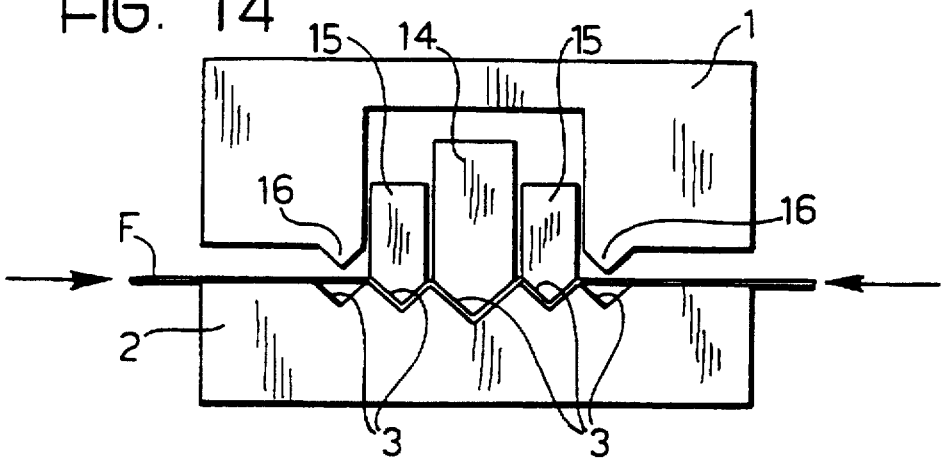
Figure 15:
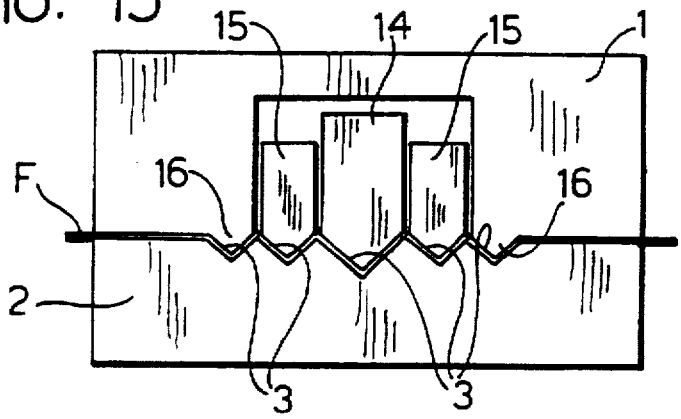

This sequence of steps is shown schematically in FIGS. 13 to 15 which show that the pleating of the sheet F is not achieved by a single blow but, on the contrary, takes place gradually by the formation first of the central pleat, then of two side pleats on opposite sides thereof and, finally, of two further, outer pleats.

The sheet F is thus formed by a gradual movement during which the sheet F which is being pleated is drawn gradually towards the centre of the pleating device. This takes place under the yielding restraining action of the strips 12 and 13.

As stated, the presence of a lacquer or resin which has a certain lubricating effect (for example, a polyethylene resin or lacquer) on the opposite faces of the sheet F causes the pleating described to take place gradually without jerks, thus avoiding any problems of tearing of the sheet F.

Naturally, the principle of the invention remaining the same, the details of construction may be varied widely from those described and illustrated, without thereby departing from the scope of the present invention.

I claim:

1. A method of wrapping an article having at least one rounded portion, comprising the steps of:

(a) providing a first sheet of material on the order of tens of microns thick and having a coating thereon which can perform a self-lubricating function;

(b) pleating said first sheet of material gradually, progressively, and symmetrically from a central region thereof towards outer regions thereof, thereby forming symmetrical meridional pleats in a pleated portion of said first sheet of material, said pleating step including maintaining said first sheet of material generally flat and causing limited movement of said first sheet of material from said outer regions thereof toward said central region thereof while said pleats are being formed, said pleating step further including subjecting said first sheet of material to restraining action which opposes said limited movement of said first sheet of material from its outer regions toward its central region;

(c) forming the pleated portion of said first sheet of material into a dished shape while substantially eliminating said pleats from said pleated portion by unfolding-type expansion of said pleats, thereby yielding a substantially smooth, wrinkle-free surface;

(d) inserting an article into said dished shape and then joining a second sheet of material to said first sheet of material along a closed line such that said article is completely surrounded by said first and second sheets of material; and (e) cutting said first and second sheets of material along said closed line, thereby forming a rim which projects outwardly from said closed line.

2. A method for forming wrappers for food articles, the method comprising the steps of:

providing a sheet of metallic foil;

forming pleats in an area of the sheet; and forming said area into a dished shape such that the pleats are virtually entirely eliminated in the area of the sheet forming the dished shape by unfolding-type expansion of the pleats, thereby yielding a generally smooth, substantially wrinkle-free surface.

3. The method according to claim 2, wherein the step of forming pleats includes substantially symmetrically forming the pleats.

4. The method according to claim 2, further including the step of maintaining the sheet generally flat during the step of forming pleats.

5. The method according to claim 2, further including the step of causing limited movement of the sheet from outer regions of said area towards a center of said area during said step of forming pleats.

6. The method according to claim 5, further including the step of subjecting the sheet to a restraining force which opposes said limited movement.

7. The method according to claim 2, wherein the step of forming pleats includes forming the pleats progressively from a central region of said area towards outer regions of said area.

8. The method according to claim 2, wherein the step of forming pleats includes forming the pleats gradually and progressively from a central region of said area towards outer regions of said area.

9. The method according to claim 2, wherein the step of providing a sheet comprises providing a sheet with at least one face having a coating which can perform a self-lubricating function.

10. The method according to claim 9, wherein the step of providing a sheet comprises providing a sheet with the coating on both faces of the sheet.

11. The method according to claim 9, wherein the coating is a lacquer.

12. The method according to claim 11, wherein the lacquer is a polyethylene-based lacquer.

13. The method according to claim 2, wherein the metallic foil is aluminum.

14. The method according to claim 2, wherein the sheet is less than one millimeter thick.

15. The method according to claim 14, wherein the sheet is on the order of tens of microns thick.

16. The method according to claim 15, wherein the sheet is about 10 microns thick.

17. The method according to claim 13, wherein the step of providing a sheet comprises providing a sheet with at least one face having a coating which can perform a self-lubricating function and which sheet is less than one millimeter thick.

18. The method according to claim 2, wherein the step of forming pleats comprises pressing the sheet between two complementary die elements.

19. The method according to claim 2, wherein the step of forming said area into a dished shape comprises pressing the area between a punch and a die.

20. The method according to claim 19, wherein at least one of the punch and the die has a vent hole and said method further comprises preventing the formation of aeriform masses trapped behind the sheet by discharging air through said vent hole.

21. The method according to claim 2, wherein the step of forming pleats comprises forming meridional pleats.

22. The method according to claim 2, wherein the step of forming pleats comprises maintaining said sheet generally flat and forming symmetrical, meridional pleats.

23. The method according to claim 2, wherein the step of forming pleats comprises forming the pleats gradually and progressively from a central region of said area towards outer regions thereof while causing limited movement of said sheet from said outer regions toward said central region and while simultaneously subjecting said sheet to a restraining force which opposes said limited movement.

24. A method for forming a wrapper for an article, the method comprising the steps of:

providing a sheet of material having a thickness on the order of tens of microns;

forming a predetermined area of the sheet of material into a dished shape; and forming pleats in the sheet of material only in the predetermined area, prior to formation of the dished shape, the pleats being of a size such that they are virtually entirely eliminated during formation of the dished shape by unfolding-type expansion of the pleats, thereby yielding a generally smooth, substantially wrinkle-free surface.

25. A device for forming pleats in a portion of sheet material which subsequently is to be formed into a dished shape, the device comprising:

a male die element which has ribs for forming the pleats in the portion of sheet material, the ribs being arranged along meridians of a first pleating area corresponding to the portion of sheet material that is to be formed into the dished shape;

a female die element which has grooves that are oriented along meridians of a second pleating area and which are complementary to the ribs;

the ribs and the grooves of the male and female die elements being only within the first and second pleating areas, respectively; and wherein of the set of ribs and the set of grooves, one set is in a generally fixed position on its respective die element and the other set is mounted so that it can be retracted relative to its respective die element during mating of the die elements, as the pleats are formed, in a sequential manner such that pleating is carried out in distinct portions of the sheet material sequentially; and resilient means for opposing retraction of said other set.

26. The device according to claim 25, wherein the ribs and the grooves are arranged in a substantially symmetrical configuration.

27. The device according to claim 25, wherein the ribs and the grooves have generally V-shaped cross sections.

28. The device according to claim 25, wherein the ribs and the grooves have generally V-shaped cross sections and are arranged in a substantially symmetrical configuration.

29. The device according to claim 25, wherein at least one of the male die element and the female die element has restraining means in the region surrounding its respective pleating area for exerting a restraining force on the sheet material which opposes movement of the sheet material towards the centers of the first and second pleating areas.

30. The device according to claim 29, wherein the restraining means can yield resiliently.

31. The device according to claim 29, wherein the restraining means is constituted by strips of foamed material.

32. The device according to claim 29, wherein there are restraining means on both the male and female die elements.

33. The device according to claim 32, wherein the restraining means comprise a substantially continuous covering on one of the die elements and discontinuous formations on the other die element.

34. The device according to claim 25, wherein the elastic constants of the resilient means are greater for the ribs or grooves situated toward outer portions of the respective pleating area than for the ribs or grooves situated toward inner portions of the respective pleating area.

* * * * *

UNITED STATES PATENT AND TRADEMARK OFFICE

CERTIFICATE OF CORRECTION

PATENT NO. : 5,775,060

DATED : July 7, 1998

INVENTOR(S) : Pietro Ferrero

It is certified that error appears in the above-indentified patent and that said Letters Patent is hereby corrected as shown below:

In the Claims: Col. 9, line 20 (claim 17), "13" should be -- 15 --.

Signed and Sealed this

Eighteenth Day of May, 1999

*Attest:*

Q. TODD DICKINSON

*Attesting Officer*

*Acting Commissioner of Patents and Trademarks*